United States Patent [19]

Tubbs

[11] Patent Number: 4,876,554

[45] Date of Patent: Oct. 24, 1989

[54] PILLBOX ANTENNA AND ANTENNA ASSEMBLY

[75] Inventor: Duane G. Tubbs, La Mesa, Calif.

[73] Assignee: Qualcomm, Inc., San Diego, Calif.

[21] Appl. No.: 145,790

[22] Filed: Jan. 19, 1988

[51] Int. Cl.[4] ..... H01Q 13/00

[52] U.S. Cl. ..... 343/780; 343/786; 343/754

[58] Field of Search ..... 343/780, 786, 771, 761, 343/754

[56] References Cited

U.S. PATENT DOCUMENTS

| | | | |
|---|---|---|---|
| 2,556,087 | 6/1951 | Iams | 250/33.65 |
| 2,721,263 | 10/1955 | Spencer | 343/780 |
| 3,071,768 | 1/1963 | Dunbar | 343/754 |
| 3,085,201 | 4/1963 | Kendall et al. | 325/16 |
| 3,086,205 | 4/1963 | Berkowitz | 343/754 |
| 3,212,095 | 10/1965 | Ajioka | 343/780 |
| 3,226,722 | 12/1965 | Yang | 343/780 |
| 3,756,091 | 9/1973 | Miller | 74/231 |
| 3,852,762 | 12/1974 | Henf et al. | 343/780 |
| 3,945,009 | 3/1976 | Trigon | 343/7.7 |
| 4,297,710 | 10/1981 | Dupressoir | 343/756 |
| 4,329,692 | 5/1982 | Brunner | 343/780 |
| 4,345,257 | 8/1982 | Brunner | 343/780 |
| 4,667,205 | 5/1987 | Gehin | 343/786 |

FOREIGN PATENT DOCUMENTS

| | | | |
|---|---|---|---|
| 1095355 | 11/1952 | France | 343/786 |

*Primary Examiner*—J. Carroll
*Assistant Examiner*—Doris J. Johnson
*Attorney, Agent, or Firm*—Brown, Martin, Haller & McClain

[57] ABSTRACT

A directive communications antenna comprising upper and lower plates, each having a leading edge, and a parabolic reflecting cylinder disposed between and axially intersecting the plates so as to form a cavity having a focus line. The cavity is open adjacent the plate leading edges. Upper and lower lip plates respectively extend along the leading edges of the upper and lower plates with both lip plates projecting upwardly therefrom. A feed assembly comprised of a feed probe and a sub-reflector is positioned within the cavity.

17 Claims, 3 Drawing Sheets

PILLBOX ANTENNA AND ANTENNA ASSEMBLY

BACKGROUND OF THE INVENTION

1. Field of the Invention

The present invention relates to an antenna. More specifically, the present invention is a novel and improved pillbox antenna having beam directive lips formed at the antenna aperture and constructed for rotation about a radiating feed probe positioned at the focus of the antenna parabolic reflecting cylinder.

2. Background Art

Pillbox antennas have been known for their use in applications where a directional antenna is required. Typically, the pillbox antenna has been used in radar systems and in particular marine radar systems. This type of antenna has generally not been used in communications systems due to the directivity limitations of the antenna. The pillbox antenna, when mounted in a horizontal plane, provides a beam shape that is substantially sharper in directivity in the horizontal plane than that of the vertical plane.

A pillbox antenna is generally defined as a radiating cavity formed by a parabolic reflecting cylinder axially terminated by parallel plates. The cavity structure includes an open mouth or aperture formed at a forward portion of the cavity. Typically, a horn or outwardly extending lips are formed at the aperture. The lips extend forward from the aperture and diverge symmetrically from a common plane defined by the parallel plates while diverging on opposite sides of the common plane. This configuration of lips dictates a beam pattern that spreads out in the vertical plane when the antenna is mounted in the horizontal plane.

It is, therefore, an object of the present invention to provide a new and improved highly directional rotatable pillbox antenna and antenna assembly for telecommunication applications.

SUMMARY OF THE INVENTION

The present invention encompasses a novel and improved antenna and assembly adapted for mounting upon a vehicle. The antenna assembly is specifically configured for use in a telecommunications system which involves the transmission and reception of data between a moving vehicle and one of a series of earth orbit geosynchronous communications satellites.

It is preferred in such a communications system that the vehicle mounted antenna be of the directive type. The pillbox antenna is, by its nature, a directive antenna. The use of a horizontal plane mounted pillbox antenna having upwardly oriented lips formed at the antenna aperture provide an enhanced beam directivity in communications with a satellite. Furthermore, mounting the antenna for rotation about a feed probe extending into the antenna cavity along the antenna focus line provides a simplification in construction of the antenna.

The present invention is a directive communications antenna comprising upper and lower plates, each having a leading edge, and a parabolic reflecting cylinder disposed between and axially intersecting the plates so as to form a cavity having a focus line. The cavity is open adjacent the plate leading edges. Upper and lower lip plates respectively extend along the leading edges of the upper and lower plates with both lip plates projecting upwardly therefrom. A feed assembly comprised of a feed probe and a sub-reflector are positioned within the antenna cavity.

BRIEF DESCRIPTION OF THE DRAWINGS

These and other features, objects, and advantages of the present invention will be more fully apparent from the detailed description set forth below, taken in conjunction with the drawings in which like reference characters identify correspondingly throughout and wherein.

DETAILED DESCRIPTION OF THE PREFERRED EMBODIMENTS

Figure 1:
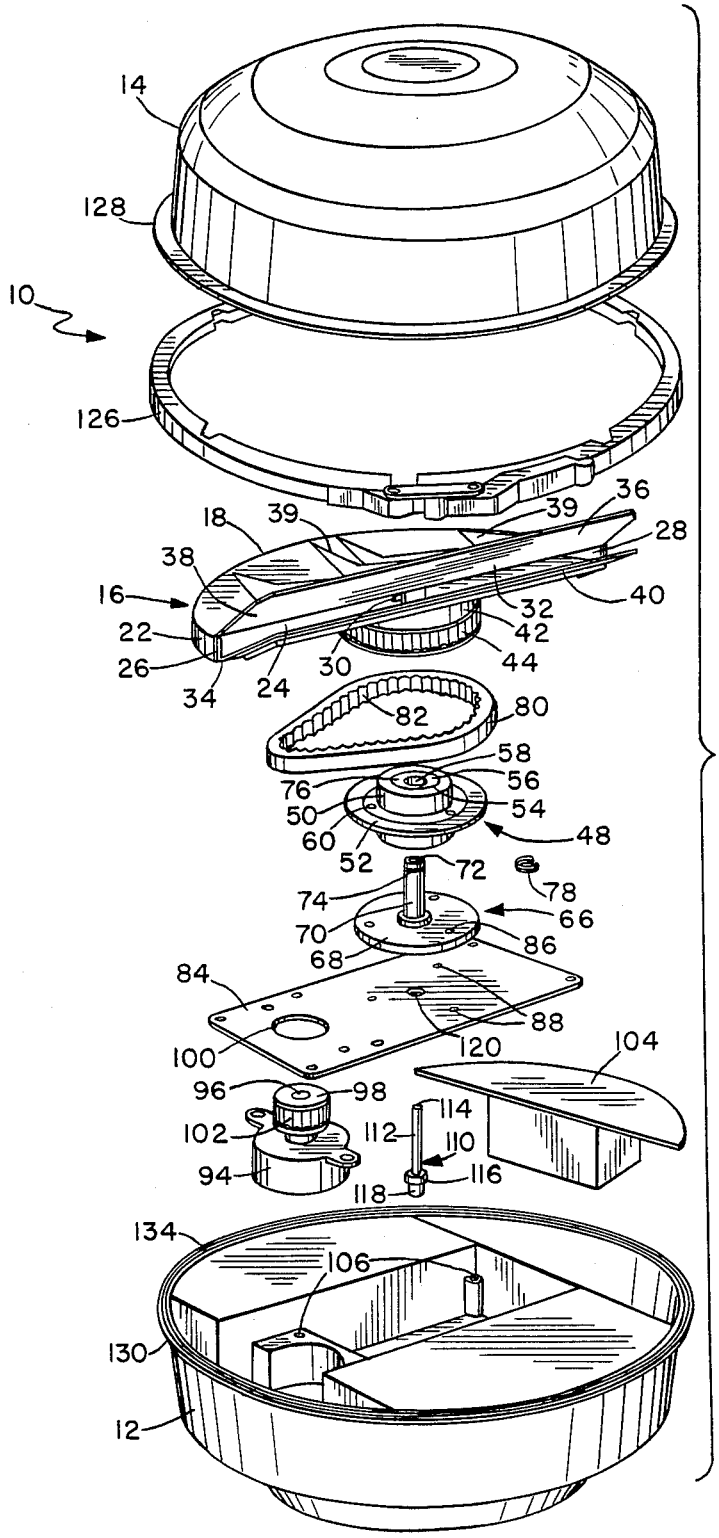
FIG. 1 is an exploded perspective view of the antenna assembly components.

Referring now to the drawings, FIG. 1 illustrates the components of antenna assembly 10 in an exploded perspective view. The antenna and antenna drive system are mounted within a cavity formed by a protective housing comprised of lower casing 12 and upper casing or radome 14.

Antenna 16 is a pillbox-type antenna formed by upper plate 18 and lower plate 20 having disposed between and axially intersecting therewith back wall or parabolic reflecting cylinder 22. Cylinder 22 has upper and lower axial edges that are respectively affixed to upper and lower plates 18 and 20. Cylinder 22 is generally perpendicular to lower plate 20 while extending upwardly therefrom to intersect with upper plate 18. In the illustrated embodiment of the invention, plates 18 and 20 do not lie in parallel planes with one another. However, it is readily understood that plates 18 and 20 may lie in parallel planes. Plates 18 and 20, along with cylinder 22, form a radiating cavity 24. Cylinder 22 is shaped in the form of a plane parabola having a focus line along the parabolic axis and a focus set back in cavity 24 from the intersection of the parabolic axis and a line connecting the opposite forward edges 26 and 28 of cylinder 22. Axial throughbore 30 is formed in lower plate 18 on the focus line of cylinder 22.

The forward edges of plates 18 and 20, edges 32 and 34, along with the forward edges 26 and 28 of cylinder 22 form an open mouth or aperture 36 for cavity 24. Mounted respectively on plates 18 and 20 at forward edges 32 and 34, are plates or lips 38 and 40. Lips 38 and 40 respectively extend along edges 32 and 34 and project upwardly with respect to the plane of plates 18 and 20. Lips 38 and 40 diverge asymmetrically from a common plane therebetween and on the same side of a plane defined by lower plate 20. A set of spaced apart vertical support ribs 39 are formed along an upper surface of top plate 18 and intersect with lip 38. Similarly, a set of spaced apart vertical support ribs 41 (FIGS. 2 and 3) are formed on a lower surface of lower plate 20 and intersect with lip 40.

Integrally formed upon the lower surface of plate 20 is a cylindrical pulley 42 having vertically oriented teeth 44 formed on the outer radial surface thereof. Pulley 42 is formed on lower plate 20 so as to be positioned centrally about the axis of throughbore 30. The positioning of pulley 42 permits rotation of antenna 16 about the axis of throughbore 30. Pulley 42 includes a centrally located cylindrical cavity 46 (FIG. 3) that shares a common axis with throughbore 30.

Pulley 42 is mounted upon pulley hub assembly 48. Pulley hub assembly 48 includes a cylindrical hub 50 with a radially extending flange 52. Hub 50 includes an enlarged central axial bore 54 into which a set of bearings 56 are typically press fitted. Bearings 56 form a central axial opening 58 through hub 50. Hub 50 includes in flange 52 a set of radially spaced apart axial holes 60. Bolts 62 (FIG. 3) through holes 64 into aligned threaded holes (FIG. 3) in pulley 42.

Pulley hub assembly 48 is rotably mounted upon spindle 66. Spindle 66 includes a circular base 68 and a centrally located post 70 extending upwardly therefrom. Post 70 has a centrally located axially bore 72 which also extends through base 68. Post 70 includes an outer radial groove 74 adjacent the end of post 70 opposite base 68. Pulley hub assembly 48 is mounted upon spindle 66 with opening 58 receiving post 70 therethrough. Post 70 contacts beariangs 56 to enable rotation of hub 50 with respect to post 70. Post 70 extends through opening 58 beyond top surface 76 of bearings 56 at the top end of hub 50 so that groove 74 is exposed. Retaining clip 78 is placed in groove 74 and contacts top surface 76 of bearings 56 so as to retain pulley hub assembly 48 upon spindle 66.

Belt 80 having teeth 82 formed on an inner surface thereof is positioned over pulley 42 so that teeth 82 engage with teeth 44 of pulley 42. The coupled pulley hub assembly 48 and spindle 66 are the coupled to pulley 42 by bolts 62.

Spindle 66 is mounted upon the upper surface a rectangular mounting plate 84. Spindle 66 includes radially spaced apart axial holes 86 formed in base 68. Holes 86 are aligned with holes 88 formed in mounting plate 84. Bolts 90 (FIG. 3) are positioned through holes 86 and 88 where nuts 92 (FIG. 3) retain bolts 92 in position.

Mounted adjacent one end of plate 84 is motor 94. The housing of motor 94 is positioned adjacent the lower surface of plate 84. Motor 94 has shaft 96 upon which pulley 98 is mounted. Shaft 96 and pulley 98 extend upwardly through hole 100 in plate 84. Pully 98 includes vertical teeth 102 positioned on the outer radial surface thereof. The inner toothed surface of belt 80 fits over the outer toothed surface of pulley 96 where teeth 82 of belt 80 engage with teeth 102 of pulley 98. Activation of motor 94 rotatably drives antenna 16 through the positive drive system of pulley 98, belt 80 and pulley 42.

Pulleys 42 and 98 along with belt 80 form a positive power transmission system for transferring rotational power from motor 94 to antenna 16. One example of such a transmission system is disclosed in U.S. Pat. No. 3,756,091, the disclosure of which is incorporated by reference.

Motor control circutiry (not shown) is mounted within lower casing 12 with cover 104 mounted over the circuit. The motor control circuitry is conventional motor control circuitry well known in the art for controlling the rotation and position of motor shaft 96. For accurate positional control of antenna 16, motor 94 is typically a stepping motor with the motor control circuitry being conventional stepping motor controller.

Plate 84 is mounted upon standoffs 106 formed in lower casing 12. Also mounted within lower casing 12 are the transceiver electronics (not shown).

Antenna assembly 10 further includes feed probe 110 which comprises a cylindrical outer insulator 112 which surrounds a center conductor 114. Adjacent one end of probe 110 is a cylindrical shank 116 while at the same end is coupler 118. Coupler 118 mates with a waveguide channel (not shown) or other suitable mating coupling in the transceiver electronics. Upon assembly of antenna assembly 10, probe 110 extends through a series of aligned holes into cavity 24 of antenna 16. Probe 110 extends through hole 120 in plate 84, opening 72 and throughbore 30 into cavity 24. Probe 110 when positioned in throughbore 30 is located on the antenna focus line rearward towards cylinder from lips 38 and 40, and the antenna focus. Insulator 112 and conductor 114 extend into cavity 24 with the top end of insulator 112 contacting the inner surface of top plate 18. Shank 116 is press-fit into an enlarged opening 122 in base 68 of spindle 66, with opening 122 aligned with bore 72. As antenna 16 rotates about spindle 66, probe 110 remains fixed. When antenna assembly 10 is used in a transmit mode, probe 110 radiates omnidirectionally into cavity 24.

When antenna assembly 10 is assembled, the antenna drive system and antenna 16 are encased within cavity 124 (FIG. 3) formed by casing 12 and radome 14. Radome 14 is placed upon casing 12 where band 126 encircles mating lips 128 and 130 respectively formed about the periphery of casing 12 and radome 14. Band 126 includes a clamping assembly 128 which tightens and secures band 126 to lips 128 and 130. As assembled, antenna assembly 10 forms a low profile, compact antenna and transceiver system.

Figure 2:
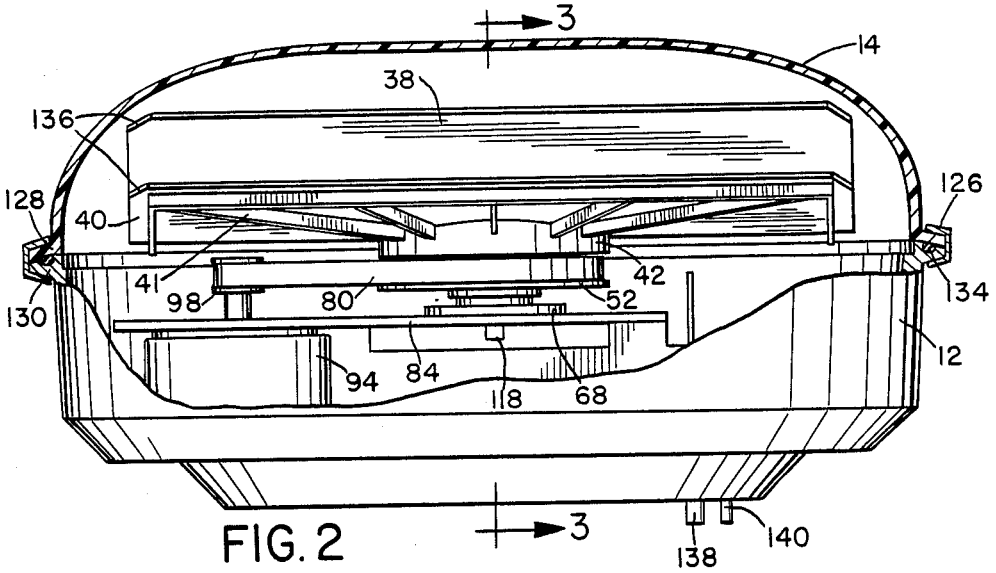
FIG. 2 is a front elevation view of the assembled antenna assembly, with portions cut away.

FIG. 2 illustrates antenna assembly 10 in assembled form. In FIG. 2, radome 14 is mounted upon casing 12 so as to form cavity 124 therein. Positioned between lips 128 and 130 is O-ring 134. O-ring 134 serves as a mechanism which ensures a tight seal between lips 128 and 130 when band 126 secures radome 14 upon casing 12.

In FIG. 2, pulley 98, mounted upon the upper end of shaft 96 of motor 94, is positioned in planer alignment with pulley 42 to insure proper alignment of belt 80. Motor 94 drives pulley 98 which, via belt 80, rotates pulley 42 and pulley hub assembly 48 about post 70 of spindle 66. Direct coupling of pulley 42 to antenna lower plate 20 enables rotation of antenna 16 within cavity 124. Edge notches 136 are formed on the outer corners of lips 38 and 40 to provide clearance for the lips during rotation of antenna 16 within cavity 124. Notches 136 permit a dome-shaped contour of radome 14 to be utilized.

Figure 3:
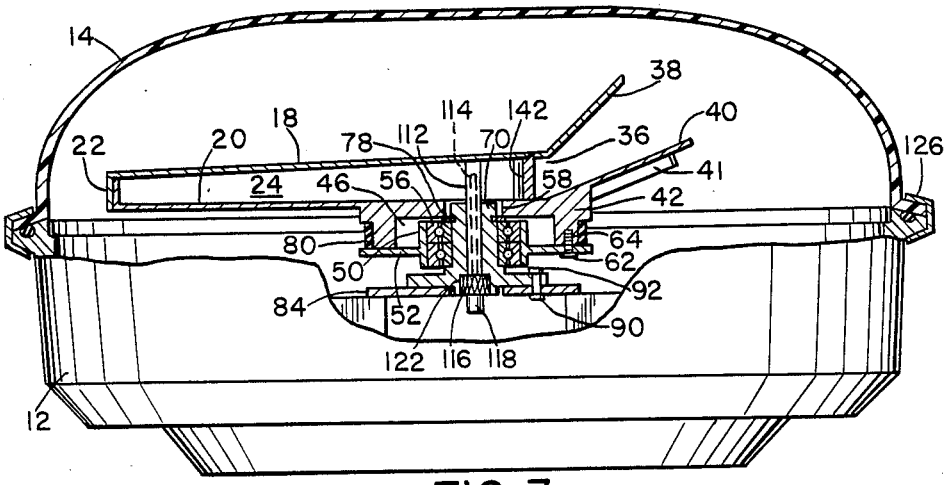
FIG. 3 is a sectional view taken on line 3—3 of FIG. 2.

FIG. 3 illustrates a cross-sectional view of antenna assembly 10 taken along 3—3 of FIG. 2. In FIG. 3, casing 12 typically manufactured of a durable lightweight material such as aluminum. Radome 14 is typically constructed from the well-known type of material, such as thermal plastic materials or other organic materials, suitable for radome use.

The exterior dimensions of casing 12 is approximately 11 inches in diameter and 2.2 inches deep. The exterior dimensions of radome 14 is approximately 11 inches in diameter and 2.5 inches in height. Furthermore, casing 12 may include exterior mounting brackets (not shown) for mounting antenna assembly 10 to a vehicle. A pair of connectors 138 and 140 are mounted in the bottom wall of casing 12 for coupling power to antenna assembly 10 along with communication and control signals between antenna assembly 10 and the vehicle upon which the unit is mounted.

Bolts 62 extend through holes 60 in pulley hub assembly 48 where they are threadably engaged in threaded holes 64 in pulley 42. Pulley hub assembly 48 is retained upon spindle by retaining clip 78 as positioned in groove 74. Spindle 66 is affixed to mounting plate 84 by bolts 90 which extend through holes 88 and threadably engage with nuts 92.

Antenna 16 is typically fabricated from a lightweight material such as aluminum or a plated composite material such as nickel-coated graphite fibers embedded in a polycarbonate material. In the construction of antenna 16, upper and lower plate 18 and 20 may be substantially parallel. In a preferred embodiment, as illustrated in FIGS. 1–3, the antenna is slightly greater in height at aperture 36 than at the vertex of curvature of cylinder 22. For example, as illustrated in FIGS. 1–3, there is a 4:3 ratio of height at aperture 36 to that at the vertex of curvature of cylinder 22.

Mounted upon the upper inner surface of bottom plate 20, adjacent to aperture 36 and within cavity 24, is sub-reflector 142. Sub-reflector 142 is a configured as a radial section of a parabolic reflecting cylinder. Sub-reflector 142 is concave facing cylinder 22. Sub-reflector 142 is positioned along a line defined by the vertex of curvature of cylinder 22 and probe 110, i.e. the parabolic reflecting cylinder focus line. Reflector 142 is generally axially positioned at the focus of cylinder 22 located on the focus line between probe 110 and lip 40.

Lip 38 is generally positioned at an angle of approximately 45 degrees with respect to a horizontal plane defined by lower plate 20. Lip 40 is typically at an angle approximately 18 degrees from the horizontal plane defined by lower plate 20. Lips 38 and 40 provide enhanced directivity in beam shape for communications between the vehicle mounted antenna and a communications satellite.

Figure 4:
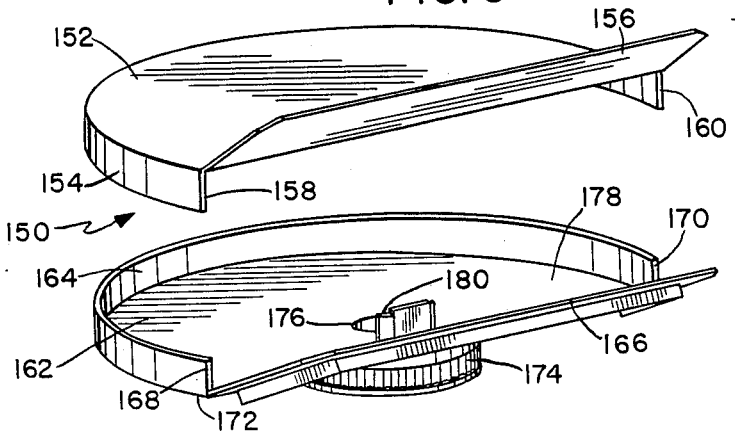
FIG. 4 is an exploded perspective view of an alternative construction for a pillbox antenna.

FIG. 4 illustrates an alternate embodiment of a pillbox antenna. Antenna 150 is a typical pillbox-type antenna configured for minimal part count and adapted for injection molding processes in its construction. In this type of antenna construction, the preferred material is a conductive material such as nickel-coated graphite polycarbonate that is ultimately plated with a conductive material.

Antenna 150 is comprised of an upper portion which includes upper plate 152 intersected by downwardly directed parabolic reflecting cylinder 154. Plate 152 has an integrally formed upwardly flared portion or lip 156 formed across plate 152 between the forward edges 158 and 160 of cylinder 154.

The lower portion of antenna 150 includes lower plate 162 intersected by an upwardly directed parabolic reflecting cylinder 164. Lower plate 162 has an integrally formed upwardly flared portion or lip 166. Lip 166 is formed across plate 162 between forward edges 168 and 170 of cylinder 164. Integrally formed upon lower surface 172 of lower plate 162 is pulley 174. Pulley 174 is centrally positioned along the antenna focus line and slightly rearward towards cylinder 164 from the antenna focus. A throughbore 176 is formed at the center of pulley 174 which extends through lower plate 162. Formed on upper surface 178 of lower plate 162 is a sub-reflector 180 which is shaped as a section of a parabolic cylinder and extends upwardly towards upper plate 152. Sub-reflector 180 is formed on the antenna focus line between bore 176 and lip 166 at the antenna focus.

Antenna 150 is assembled by bonding overlapping cylinders 154 and 164 together. As discussed with reference to FIGS. 1–3, upper and lower plates 152 and 162 may be either substantially parallel or slightly diverging at aperture 182 of antenna 150. Furthermore, lips 156 and 166 are asymmetrically diverging from a common plane therebetween and on the same side of a plane defined by lower plate 162. In the embodiment as illustrated in FIG. 4, lips 156 and 166 are each fixed at a respective predetermined angle, typically 45 and 18 degrees, from a plane defined by lower plate 162. A feed probe (not shown) extends into the antenna as discussed with reference to FIGS. 1–3. Sub-reflector 180 is formed that in the assembled antenna, it contacts the lower surface of top plate 152.

Figure 5:
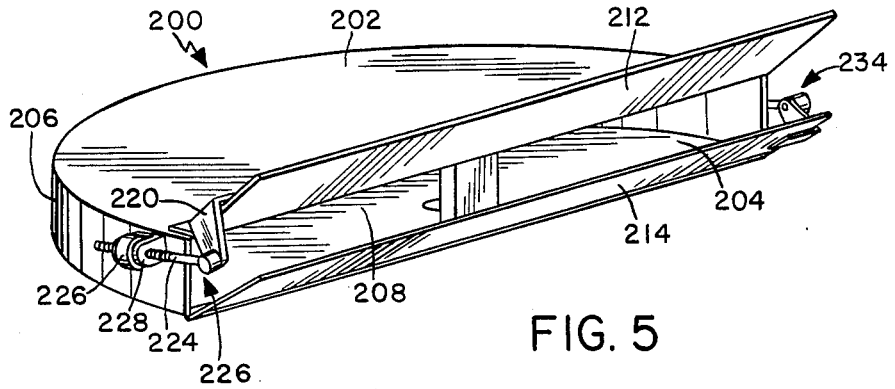
FIG. 5 is a perspective view of yet an alternative embodiment of the pillbox antenna adapted for varying the lip angles.
Figure 6:
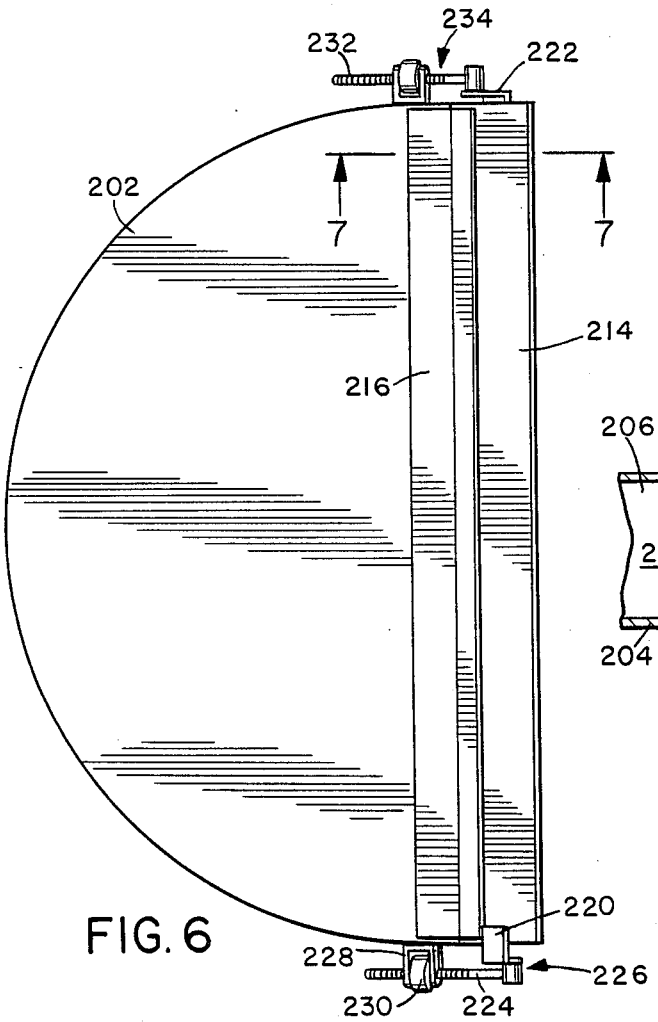
FIG. 6 is a top plan view of the structure of FIG. 5.
Figure 7:
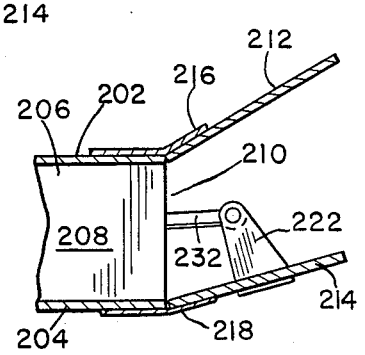
FIG. 7 is an enlarged sectional view taken on line 7—7 of FIG. 6.

FIGS. 5–7 illustrate yet another feature of the pillbox antenna of the present invention. In FIGS. 5–7 a means for varying the directivity of the beam pattern is illustrated. Antenna 200 includes upper and lower plates 202 and 204 connected by parabolic reflecting cylinder so as to form radiating cavity 208 having an aperture 210.

Lips 212 and 214 are respectively mounted on the forward edges of plates 202 and 204. Lips 212 and 214 are respectively attached to plates 202 and 204 by means such as strips of adhesive backed conductive tape 216 and 218. Lips 21 and 194 are, in essence, hinge mounted to a respective plate.

Respectively attached to lips 212 and 214 are brackets 220 and 222. Bracket 220 is pivotally coupled to arm 224 which is connected to adjustment means 226. Adjustment means 226 permits the angle of lip 212 to be adjusted. Adjustment means 226 is characterized by a bracket 228 mounted to cylinder 206. A knob 230 having a threaded bore is held by bracket 228. The portion of arm 224 opposite bracket 220 is threaded and engages with the threaded bore of knob 230. Similarly, bracket 222 is associated with arm 232 and adjustment means 234 for adjusting the angle of lower lip 214. The means by which the angle of lips 212 and 214 are adjusted can be accomplished in many different ways. The embodiment shown herein is only one such mehtod. It is further envisioned that the adjustment of lips 212 and 214 may be fully automated and under motor control.

It should be further noted that the pillbox antenna may require tuning. Therefore, tuning stubs may be added to the antenna as necessary to achieve optimal performance. In addition, a choke within may be necessary to optimize performance of the antenna. One type of choke is an angular groove within the radiating cavity formed in the lower plate and encircling the feed probe. The tuning of the antenna to particular performance characteristics is within the capability of one skilled in the art.

The previous description of the preferred embodiments are provided to enable any person skilled in the art to make or use the present invention. Various modifications to these embodiments will be really apparent to those skilled in the art and the generic principles defined herein may be applied to other embodiments without the use of the inventive faculty. The present invention is not intended to be limited to the embodiment shown herein, but is to be accorded the widest scope consistent with the principles and novel features disclosed herein.

What is claimed is:

1. A directive communications antenna comprising:

a substantially parabolic upper plate having a leading edge;

a substantially parabolic lower plate having a leading edge;

a parabolic reflecting cylinder, having a pair of leading edges, disposed between and axially intersecting said plates so as to form an antenna cavity having a focus line and an antenna focus located on said focus line within said cavity, said upper and lower plate leading edges and said parabolic reflecting cylinder leading edges aligned along a common plane defining a cavity aperture thereat;

an upper lip plate extending along said upper plate leading edge and projecting upwardly therefrom at a first predetermined angle with respect to a plane defined by said lower plate;

a lower lip plate extending along said lower plate leading edge and projecting upwardly therefrom at a second predetermined angle with respect to said plane; and electromagnetic feed means disposed along said focus line within said cavity, comprising;

a. a waveguide feed probe extending through a hole in said lower plate into said cavity at a point along said focus line; and b. a reflector extending upwardly within said cavity from said lower plate, said reflector having a concave face facing said reflecting cylinder centered on said focus line between said probe and said lower plate leading edge at said antenna cavity focus.

2. The antenna of claim 1 wherein said first predetermined angle is greater than said second predetermined angle.

3. The antenna of claim 1 further comprising rotational means coupled to said lower plate for rotating said antenna about an axis defined by said probe.

4. The antenna of claim 1 further comprising:

a hollow, substantially cylindrical upper casing having an open lower end forming a radome;

a hollow, substantially cylindrical lower casing having an open lower end, said lower casing coupled at said lower casing open end to said upper casing at said upper casing open end so as to form a housing defining a housing cavity therein, said coupled upper plate, reflecting cylinder, lower plate and corresponding lip plates along with said electromagnetic feed means rotatably disposed within said housing cavity and wherein within said housing cavity said upper plate is positioned adjacent said upper casing and said lower plate is positioned adjacent said lower casing; and retainer means for securely coupling said upper and lower casings.

5. A directive communications antenna comprising:

an upper plate having a leading edge;

a lower plate having a leading edge;

a parabolic reflecting cylinder disposed between and axially intersecting said plates so as to form a cavity having a focus line and said cavity open adjacent said leading edges;

an upper lip plate movably coupled to and extending along said upper plate leading edge and projecting upwardly therefrom;

a lower lip plate movably coupled to and extending along said lower plate leading edge and projecting upwardly therefrom;

means for adjusting said upper and lower lip plates at selected upward angles from a plane defined by said lower plate; and electromagnetic feed means mounted along said focus line within said cavity.

6. The antenna of claim 5 wherein said electromagnetic feed means comprises:

a waveguide feed probe extending through a hole in said lower plate into said cavity at a point along said focal line; and a reflector extending upwardly within said cavity from said lower plate, said reflector centered on said focus line between said probe and said lower plate leading edge.

7. The antenna of claim 5 further comprising rotational means coupled to said lower plate for rotating said antenna about an axis defined by said probe.

8. The antenna of claim 5 further comprising:

a radome; and a lower casing coupled to said radome and forming a radome cavity therein, wherein within said radome cavity said upper plate is positioned adjacent said radome and said lower plate is positioned adjacent said lower casing.

9. A directive communications antenna comprising:

an upper plate having an upwardly flared edge portion;

a lower plate having an upwardly flared edge portion;

a parabolic reflecting cylinder disposed between and axially intersecting said plates so as to form a cavity having a focus line and said cavity open adjacent said upwardly flared portions;

means for adjusting said upper and lower plate flared edge portions at selected upward angles from a plane defined by said lower plate; and electromagnetic feed means positioned along said focus line within said cavity.

10. The antenna of claim 9 wherein said electromagnetic feed means comprises:

a waveguide feed probe extending through a hole in said lower plate into said cavity at a point along said focus line; and a reflector extending upwardly within said cavity from said lower plate, said reflector centered on said focus line between said probe and said lower plate leading edge.

11. The antenna of claim 9 further comprising rotational means coupled to said lower plate for rotating said antenna about an axis defined by said probe.

12. The antenna of claim 9 further comprising:

a radome; and a lower casing coupled to said radome and forming a radome cavity therein, wherein within said radome cavity said upper plate is positioned adjacent said radome and said lower plate is positioned adjacent said lower casing.

13. A directive communications antenna comprising:

an upper member comprised of a first plate having an upwardly flared forward edge portion and a downwardly extending parabolic reflecting cylinder axially formed at a rearward edge portion thereof opposite said first plate upwardly flared forward edge portion;

a lower member comprised of a second plate having an upwardly flared forward edge portion and an upwardly extending parabolic reflecting cylinder axially formed at a rearward edge portion thereof, said second plates mounted together with said first and second plate cylinders, overlapping one another so as to form a cavity having a focus line with said cavity open adjacent said upwardly flared forward portions of said first and second plates;

means for adjusting said upper and lower plate flared edge portions at selected upward angles from a plate defined by said lower plate; and electromagnetic feed means positioned along said focus line within said cavity.

14. A directive communications antenna assembly comprising:

a parabolic-shaped upper plate having an upwardly flared edge portion formed adjacent a line intersecting opposite side edges of said upper plate;

a parabolic-shaped lower plate having an upwardly flared edge portion formed adjacent a line intersecting opposite side edges of said lower plate;

a parabolic-shaped reflecting wall disposed between and axially intersecting said upper and lower plates, said reflecting wall increasing in height between said upper and lower plates from a vertex of curvature of said reflecting wall towards a pair of forward edges of said reflecting wall opposite said vertex, said reflecting wall having a concave face facing said upper and lower plate edge portions, said upper and lower plate edge portions respectively upwardly flared at first and second angles with respect to a plane formed by said bottom plate with said first angle greater than said second angle, said upper and lower plates with said reflecting wall defining an antenna cavity having an opening adjacent said upper and lower plate edge portions and said reflecting wall forward edges, said antenna cavity having a focus line with an antenna cavity focus on said focus line adjacent said opening;

a parabolic-shaped sub-reflecting wall disposed within said antenna cavity on said lower plate along said focal line at said focus, said sub-reflecting wall having a concave face facing said reflecting cylinder with a vertex of curvature at said focus, said sub-reflecting wall being of a shape corresponding to a radial section of said reflecting wall; and a waveguide feed probe extending through a hole in said lower plate into said antenna cavity at a point along said focal line between said sub-reflecting wall and said reflecting wall.

15. The antenna assembly of claim 14 further comprising rotational means coupled to said lower plate for rotating said antenna assembly about an axis defined by said probe.

16. The antenna assembly of claim 15 wherein said rotational means comprises:

a pulley mounted to said lower plate having a central axial throughbore aligned with said hole in said lower plate;

a spindle having an axial throughbore;

hub assembly means for rotatably coupling said spindle to pulley means with said spindle throughbore axially aligned with said pulley throughbore; and rotational driving means engaging said pulley means for rotatably driving said pulley.

17. The antenna assembly of claim 15 further comprising:

a hollow, substantially cylindrical upper casing having an open lower end and formed of a substantially electromagnetically transparent material;

a hollow, substantially cylindrical lower casing having an open upper end, said lower and upper casings engaging one another at its respective open ends so as to define an enclosure cavity for receiving said coupled upper and lower plates, said reflecting and sub-reflecting walls and said probe disposed within said enclosure cavity; and retainer means for securing together said upper and lower casings.

* * * * *